US005212893A

United States Patent [19]

Pozzobon

[11] Patent Number: 5,212,893

[45] Date of Patent: May 25, 1993

[54] FLEXIBILITY ADJUSTMENT FASTENER PARTICULARLY FOR SKI BOOTS

[75] Inventor: Alessandro Pozzobon, Paderno di Ponzano Veneto, Italy

[73] Assignee: Nordica S.p.A., Montebelluna, Italy

[21] Appl. No.: 706,502

[22] Filed: May 28, 1991

[30] Foreign Application Priority Data

Jun. 15, 1990 [IT] Italy ..... 82587 A/90

[51] Int. Cl.[5] ..... A43B 5/04; A43B 5/16

[52] U.S. Cl. ..... 36/120; 36/117

[58] Field of Search ..... 36/117, 118, 119, 120, 36/121

[56] References Cited

U.S. PATENT DOCUMENTS

| | | | |
|---|---|---|---|
| 3,721,023 | 3/1973 | Kastinger | 36/120 |
| 3,885,329 | 5/1975 | French | 36/120 |
| 4,280,286 | 7/1981 | Sartor | 36/121 X |
| 4,334,368 | 6/1982 | Chalmers, II et al. | 36/121 |
| 4,539,764 | 9/1985 | Pradier | 36/121 |
| 4,575,955 | 3/1986 | Borsoi | 36/117 |
| 4,601,118 | 7/1986 | Zanatta | 36/120 |
| 4,611,415 | 9/1986 | Tonel | 36/120 |
| 4,615,128 | 10/1986 | Borsoi | 36/120 |
| 5,068,984 | 12/1991 | Kaufman et al. | 36/117 |
| 5,088,211 | 2/1992 | Walkhoff | 36/117 |

FOREIGN PATENT DOCUMENTS

| | | | |
|---|---|---|---|
| 369243 | 12/1982 | Austria . | |
| 406212 | 1/1991 | European Pat. Off. . | |
| 2535793 | 2/1977 | Fed. Rep. of Germany | 36/121 |
| 2570936 | 4/1986 | France | 36/117 |
| 2617380 | 1/1989 | France | 36/117 |
| 638383 | 9/1983 | Switzerland . | |

*Primary Examiner*—Steven N. Meyers
*Assistant Examiner*—Beth Anne Cicconi
*Attorney, Agent, or Firm*—Guido Modiano; Albert Josif

[57] ABSTRACT

A flexibility adjustment device, particularly for ski boots composed of a shell with which at least one quarter is associated by means of at least one stud. The device is constituted by a resilient member which is interposed between the shell or a pivot and a first ring which constitute the stud together with a second ring which is rotatably associated with the pivot and can be secured on the first ring. The securing of the second ring on the first ring allows to vary the degree of lateral oscillation of the quarter with respect to the shell.

8 Claims, 1 Drawing Sheet

FLEXIBILITY ADJUSTMENT FASTENER PARTICULARLY FOR SKI BOOTS

BACKGROUND OF THE INVENTION

The present invention relates to a flexibility adjustment fastener, particularly for ski boots.

The problem of being able to adjust the angular position of the quarters with respect to the plane of the sole is currently strongly felt: in known ski boots, this variation is obtained for example by imparting a deformation to the quarters, with consequent problems due to fatigue of the materials or to permanent deformations.

In known central- or rear-entry ski boots, which as such have a shell with overlapping flaps and with separate front and rear quarters, there is the problem due to the fact that the transverse translatory motion of the front quarter, in direct contact with the shell, for the adjustment of the angular position with respect to the sole, creates empty spaces in the region at which the two components overlap one another.

This situation causes a variation in the interference characteristics and therefore in the flexibility of the boot.

It has furthermore been observed that during flexing, since the quarters are mutually secured and articulated at the same point on the shell, their degree of mutual securing is altered.

As a partial solution to these disadvantages, this same Assignee filed Jul. 9, 1982, U.S. patent application Ser. No. 06/396,548 granted Mar. 18, 1986 as U.S. Pat. No. 4,575,955.

In said Patent, which is incorporated herein by reference, said boot has the peculiarity of having a front quarter which has a first part which predominantly affects the lateral regions of a skier's leg and is pivoted to the shell, and a second part which predominantly affects the front region of the skier's leg; said second part can be partially superimposed on the first part and is articulated thereto so as to allow a different degree of inclination with respect to the shell in the direction of the tip thereof.

Though this solution is undoubtedly valid, it has the disadvantage of maintaining a considerable lateral rigidity for the quarter, since the first and second parts are mutually fixed and are therefore subjected to deformations, especially if said boot is used in connection with a "snowboard".

This same Assignee filed Jul. 16, 1984, U.S. patent application Ser. No. 06/631,361 granted Sep. 16, 1986 as U.S. Pat. No. 4,611,415, which discloses a flexibility adjustment device in ski boots and the like, the peculiarity of which consists of the fact that it comprises at least one elastic element supported by the shell, an articulation pivot passing through said elastic element, at least the front quarter being connected to said pivot.

This solution still has limitations: the elastic element in fact only allows to damp the oscillation of the quarters exclusively along their longitudinal axis: this is still a limitation if the boot is of the type which can be used for snowboarding.

SUMMARY OF THE INVENTION

The aim of the present invention is therefore to eliminate the disadvantages described above in known types by providing a device which allows the boot to adapt, during the practice of sports, to the changing needs of the skier which are due to the various positions assumed by the legs, and therefore for front, rear and lateral movements of the legs.

Within the scope of the above described aim, an important object is to provide a device which effectively prevents the component elements of the boot from deforming while skiing.

Another object is to provide a device which allows to achieve a controlled and presettable lateral as well as front oscillation of the boot quarters.

Another important object is to provide a boot which associates with the preceding characteristics those of being structurally simple and of being easy and rapid to assemble.

Still another object is to provide a boot which is safe and reliable in use.

Not least object is to provide a boot which associates with the preceding characteristics that of having modest manufacturing costs.

This aim, these objects and others which will become apparent hereinafter are achieved by a flexibility adjustment device, particularly for ski boots composed of a shell with which at least one quarter is associated by means of at least one stud, characterized in that it is constituted by at least one elastically deformable element which is interposed between said shell or a pivot and a first ring which constitute said stud together with a second ring which is rotatably associated with said pivot and can be secured on said first ring.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
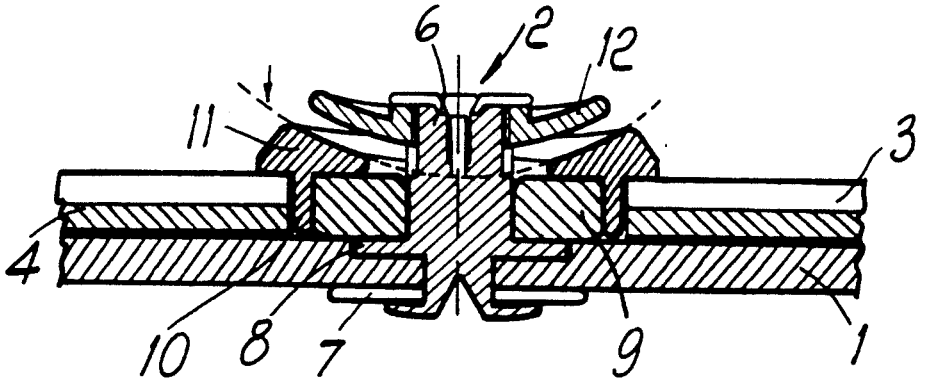
FIG. 1 is a side sectional view of the device taken along a diametrical sectional plane which passes through the pivoting stud.

With reference to the above figures, a ski boot of the rear-entry type, not illustrated in the figures, has been considered; said boot is thus constituted by a shell, indicated by the reference number 1, with which a front quarter 3 and a rear quarter 4 are associated by means of adapted studs 2 which are arranged laterally.

Alternatively, the boot may be of the type constituted by a single quarter.

The flexibility adjustment device or fastener preferably comprises two studs 2, one for each side of the boot, and each of the studs comprises a pivot 6 which passes through the shell 1, the front quarter 3 and the rear quarter 4.

One end of pivot 6 is internal to the shell 1 and is riveted thereon by interposing a washer 7; the pivot is locked onto the shell 1 by an annular tang 8 which protrudes radially from pivot 6 and interacts with the internal surface of said shell 1.

The flexibility adjustment device is furthermore constituted by at least one resilient member 9, which is constituted by an elastic ring interposed between pivot 6 and the internal lateral surface of a rim 10 which protrudes downward from a first ring 11 which in turn is arranged coaxially to said pivot 6.

The first ring 11 is thus axially bored for the passage of the pivot 6, whereas the diameter of rim 10 is greater than that of pivot 6 and than that of the hole of the first ring 11.

The front quarter 3 and the rear quarter 4 abut at the outer lateral surface of rim 10.

The upper surface of the first ring 11 is approximately spherical.

At its end which does not interact with the shell 1, the pivot 6 is externally threaded, and a complementarily threaded second ring 12 interacts therewith; said second ring can be operated by the skier and has means for securing it to the underlying first ring 11.

Advantageously, the downward face of the second ring 12 is shaped complementarily to the underlying upper surface of the first ring 11.

The use of the device is as follows: once the various components of the device have been assembled, the lateral oscillation of the quarter is allowed by the gap between the first ring and the second ring.

The two facing surfaces of said rings in fact mutually interact until they arrange themselves in abutment by virtue of the deformation of the resilient member 9.

Said resilient member 9 is compressed against the pivot 6 by the quarters.

In order to adjust the degree of lateral oscillation, it is sufficient to screw more or less tightly the second ring 12 on the pivot 6, increasing or reducing the gap with respect to the first ring 11.

It has thus been observed that the invention has achieved the intended aim and objects, since the device allows the boot to adapt to the changing needs of the skier which are due to various positions assumed by the legs, and therefore for front, rear and lateral movements of the legs.

The activation of the second ring in fact allows to achieve a controlled and presettable lateral, as well as front, oscillation of the quarters of the boot.

The device is furthermore structurally simple as well as easy and rapid to assemble, and this leads to modest manufacturing costs.

The device according to the invention is naturally susceptible to numerous modifications and variations, all of which are within the scope of the same inventive concept.

Figure 2:
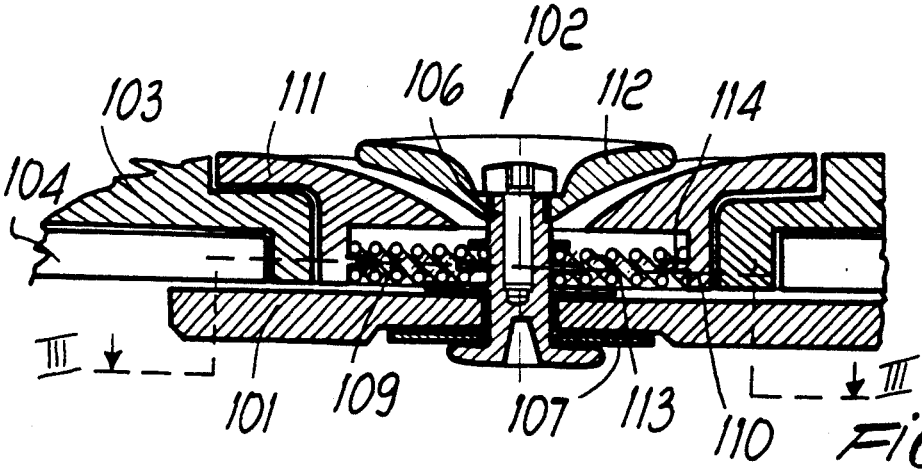
FIG. 2 is a view, similar to the preceding one, of the device according to a further aspect of the invention, having a different resilient member.
Figure 3:
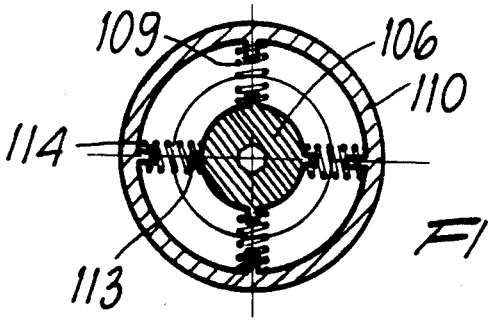
FIG. 3 is a top sectional view according to the line III—III of FIG. 2.

Thus, for example, the elastically deformable element 109 can be constituted, as illustrated in FIGS. 2–3, by a plurality of springs which are arranged radially with respect to the pivot 106, the ends of each spring being arranged at adapted pins 113 and 114 which protrude from the pivot 106 and from the rim 110 respectively.

Figure 4:
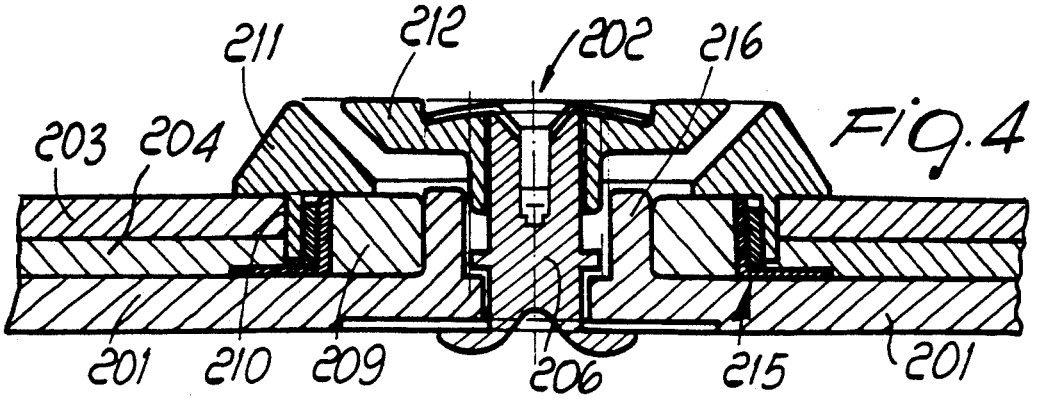
FIG. 4 is a view, similar to the preceding one, of the device according to a third aspect of the invention.

Alternatively, as shown in FIG. 4, the elastically deformable element 209 can be interposed between rings or L-shaped elements 215, arranged at the internal surface of the rim 210, and a bush 216 which protrudes perpendicular to the shell 201 at the hole for the passage of the pivot 206.

The dimensions, as well as the materials which constitute the individual components of the device, may naturally be the most appropriate according to the specific requirements.

I claim:

1. Flexibility adjustment fastener, connected to a ski boot comprising a shell and at least one quarter, comprising:

a pivot element for pivotally connecting said quarter to said shell, said pivot element extending through a bore of said quarter and being rigidly connected to said shell;

a first ring element accommodated inside said bore and arranged circumferentially to said pivot element;

at least one resilient member arranged circumferentially to said pivot element and between said first ring and said shell;

a second ring connected to said pivot element and arranged at a distance above said first ring; and means for connecting said second ring to said pivot element which allow adjustment the distance between said second ring and said first ring.

2. The flexibility adjustment fastener according to claim 1 wherein said means for connecting said second ring to said pivot element comprise a threaded connection between said second ring and said pivot element.

3. The flexibility adjustment fastener according to claim 1, wherein said first ring is provided with an upper surface facing said second ring, said second ring being provided with a lower surface facing said upper surface of said first ring, said upper surface and said lower surface being mutually complimentarily shaped.

4. The flexibility adjustment fastener according to claim 3, wherein said lower surface and said upper surface both having a curved surface of constant radius.

5. The flexibility adjustment fastener according to claim 1, wherein said resilient member comprises an elastic ring, said first ring comprising an annular rim accommodated in said bore of said quarter, said elastic ring being interposed between said annular rim and said pivot element.

6. The flexibility adjustment fastener according to claim 1, wherein said resilient member comprises an elastic ring, said first ring comprising an annular rim accommodated in said bore of said quarter, said shell being provided with a bush protruding perpendicularly thereto and circumferentially surrounding said pivot element, said elastic ring being interposed between said annular rim and said bush with an interposition of ring elements between said elastic ring and said annular rim.

7. The flexibility adjustment fastener according to claim 1, wherein said first ring comprises an annular rim accommodated in said bore of said quarter, said resilient member comprising a plurality of springs arranged radially with respect to said pivot element and connected at ends thereof to pin elements protruding from said pivot element and said annular rim of said first ring.

8. The flexibility adjustment fastener according to claim 1, wherein said pivot element pivotally connects a front quarter and a rear quarter to said shell, said pivot element extending through overlying bores of said front quarter and said rear quarter.

* * * * *